US006540221B2

(12) United States Patent
Nakashima et al.

(10) Patent No.: US 6,540,221 B2
(45) Date of Patent: Apr. 1, 2003

(54) FEEDER OF AN IMAGE FORMING APPARATUS

(75) Inventors: Akira Nakashima, Soraku-gun (JP); Takashi Kubo, Soraku-gun (JP); Yasumasa Morimoto, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/929,314

(22) Filed: Aug. 14, 2001

(65) Prior Publication Data

US 2002/0060394 A1 May 23, 2002

(30) Foreign Application Priority Data

Aug. 29, 2000 (JP) ..... 2000-259846

(51) Int. Cl.[7] ..... B65H 3/52
(52) U.S. Cl. ..... 271/121; 271/124; 271/126
(58) Field of Search ..... 271/117, 121, 271/124, 126, 127

(56) References Cited

U.S. PATENT DOCUMENTS 5,253,854 A * 10/1993 Tanoue et al. ..... 271/121
5,358,230 A * 10/1994 Ikemori et al. ..... 271/121
5,372,359 A * 12/1994 Miura et al. ..... 271/121
5,725,208 A * 3/1998 Miyauchi ..... 271/121
5,984,297 A * 11/1999 Tanaka ..... 271/126
5,997,198 A * 12/1999 Murayama et al. ..... 271/121

FOREIGN PATENT DOCUMENTS

JP 05-270680 10/1993
JP 2000-355429 12/2000

* cited by examiner

*Primary Examiner*—H. Grant Skaggs
(74) *Attorney, Agent, or Firm*—Renner, Otto, Boisselle & Sklar

(57) ABSTRACT

A movable sheet separating unit is pushed all the time by a lifting spring in a direction toward a feeding roller. In a non-feeding state, a sheet lifting plate is engaged with an operating fraction so that the movable sheet separating unit is held in a standby position where a separating pad is separated from the feeding roller. In a feeding state, the sheet lifting plate rises and disengages from the operating fraction so that the movable sheets separating unit moves to a pressing position where the separating pad is pressed against the feeding roller. In the pressing position, the separating pad is pressed against the feeding roller via a rotatable support base by a pressing spring, and is displaced by rotation in a direction away from the feeding roller in accordance with a thickness of a sheet S passing through between the separating pad and the feeding roller. Thus, durability of the separating pad can be improved, and a feeder suitable for a fixing type feeding cassette can be provided.

8 Claims, 7 Drawing Sheets

FEEDER OF AN IMAGE FORMING APPARATUS

FIELD OF THE INVENTION

The present invention is applied to image forming apparatuses such as a printer, a copy machine, and a facsimile which form images on sheets by such processes as printing and transfer, and more specifically relates to a feeder which separates stacked sheets into individual sheets in order and carries sheets to an image forming section.

BACKGROUND OF THE INVENTION

Conventionally, in a feeder of an image forming apparatus, an arrangement in which a feeding cassette storing sheets for image formation is detachably provided with respect to an image forming apparatus body has been mainly used. However, such a structure of a detachable feeding cassette inevitably increases the height of the image forming apparatus.

Recently, in image forming apparatuses such as an ink-jet printer for small volume printing, a fixing type feeding cassette which utilizes a bottom plate of the image forming apparatus body as a bottom plate of the feeding cassette tends to be installed instead of the detachable feeding cassette. Compared with the detachable type, the fixing type can store fewer sheets, but the fixing type has an advantage that the height of the image forming apparatus can be decreased.

However, in the fixing type, because it is fixed, problems which did not occur in the detachable type are brought about. That is, unlike the detachable type feeding cassettes which can classify sheets according to size and type of the sheets to some extent by the feeding cassette and can fix feeding conditions in a predetermined range, the fixing type feeding cassette need to solely cope with various sheets which differ in size, thickness, and surface smoothness, etc. Thus, feeding conditions need to be fixed with respect to every kind of sheet used in the feeder. The feeding conditions include a sheet transport power for feeding and transport sheets out of the feeding cassette, and sheet separating power for separating the sheets into individual sheets.

An arrangement of a conventional feeder using the fixing type feeding cassette is shown in FIG. 7.

As shown in FIG. 7, a bottom plate of a fixing type feeding cassette 50 makes up a bottom 57 of an image forming apparatus body, and a sheet lifting plate 59 which pushes up an end of stacked sheets S stored in the feeding cassette 50 is provided on the bottom plate 57. The sheet lifting plate 59 rises by switching off a solenoid 58, so that a front end of the sheets S stacked on the sheet lifting plate 59 is pushed against a feeding roller 51.

The feeding roller 51 is provided along a body frame 54, which is also a right side wall of the image forming apparatus, and a roller section of the feeding roller 51 is divided into plural rollers and provided on a shaft 51*a* which stretches from the front side to the rear side (see FIG. 4, an explanatory drawing of the present invention in which the feeding roller is indicated by reference number 5 and the roller section is divided into four rollers in FIG. 4).

Further, a sheet separating section for preventing transport of plural sheets S is provided below the feeding roller 51, downstream with respect to a position where a front end of the sheets S is pressed against. The sheet separating section is made up of a separating unit 52 which is provided for each of the divided rollers of the feeding roller 51.

The separating unit 52 includes a separating pad 55 thereon, and the separating pad 55 is pressed against the feeding roller 51. The separating unit 52 is fixed on the body frame 54 via a mounting fraction 52*a* with a bolt 60, and pushed along a guide rib 53 provided straight up on the bottom plate 57 of the image forming apparatus in a direction shown by an arrow e by a spring 56 whose end is fixed on the bottom plate 57. The separating pad 55 above the spring 56 is pressed against the feeding roller 51 by the pushing force of the spring 56. Here, the guide rib 53 restricts a direction of pressure in pressing the separating pad 55 against the feeding roller 51.

In this arrangement, in feeding sheets, the sheet lifting plate 59 rises by switching off the solenoid 58 and a front end of the sheets S is pressed against the feeding roller 51, so that the sheets S in the feeding cassette 50 are pulled out by rotation of the feeding roller 51 and carried between the feeding roller 51 and the separating pad 55. Here, if plural sheets S are pulled out together one over another, the plural sheets cannot pass between the feeding roller 51 and the separating pad 55 pressed against the feeding roller 51, and the sheets are separated into individual sheets to prevent transport of plural sheets. A sheet S having passed through between the feeding roller 51 and the separating pads 55 is carried to an image forming section (not shown) in accordance with the rotation of the feeding roller 51.

However, the arrangement in which a feeder employs a conventional fixing type feeding cassette brings about problems as follows.

1) In the conventional arrangement, since the separating pad 55 is pressed against the feeding roller 51 all the time, a pressed surface of the separating pad 55 tends to wear out easily. Thus, durability of the separating pad 55 is inferior. As a result, steady sheet separating power can not be maintained and steady sheet feeding over extended periods of time can not be realized.
2) In the conventional arrangement, since the separating unit 52 which includes the separating pad 55 is fixed on the body frame 54 with the bolt 60, it is difficult to displace the separating pad 55. Besides, the spring 56 for providing enough pressure to press the separating pad 55 against the feeding roller 51 to separate sheets exerts pressure diagonally with respect to a direction normal to the separating pad 55. Thus, the spring 56 used to press the separating pad 55 against the feeding roller 51 has pushing force greater than it the pressure required to separate sheets. Therefore, even if a thickness of a sheet S passing through between the separating pad 55 and the feeding roller 51 exerts such a force that a space between the separating pad 55 and the feeding roller 51 would be spread, the separating pad 55 is not separated from the feeding roller 51 and the space between them is hardly changed.

As a result, when sheets S are thin sheets of paper, it is easy to separate plural sheets into individual sheets, but when the sheets S are thick sheets of paper such as post cards, the thickness of the sheets S becomes so thick when they are transported together one over another that stronger pressure than needed is given to the sheets S. Thus, while the sheets can be separated into individual sheets, a front end of the separated sheet S is rolled up or is torn. Note that, when pressure of the spring 56 is selected based on thick sheets S such as post cards to prevent the problem which is caused when the thick sheets S are transported together one over another, the pressure required to separate the thin sheets S cannot be obtained, and transport of plural sheets S cannot be prevented.

SUMMARY OF THE INVENTION

The first object of the present invention is to provide a feeder of an image forming apparatus which can feed sheets stably over extended periods of time by improving durability of a separating pad. The second object of the present invention is to provide a feeder of an image forming apparatus which is suitable for a feeder having a fixing type feeding cassette and can prevent transport of plural sheets without fail and without impairing sheets carrying performance regardless of type, size, and surface smoothness etc. of fed sheets.

A feeder of an image forming apparatus of the present invention, to achieve the first object, pressure switching means for pressing a separating pad against a feeding roller only when feeding sheets, wherein, when feeding sheets, said pressure switching means presses the separating pad against the feeding roller, and the feeding roller is rotated, so as to separate stacked sheets into individual sheets between the feeding roller and the separating pad and carry the sheets individually to an image forming section.

According to the arrangement, since the pressure switching means presses the separating pad against the feeding roller only when feeding sheets, a pressed surface of the separating pad is hard to wear out, compared with a conventional arrangement in which the separating pad was pressed all the time. Thus, durability of the separating pad can be improved. As a result, stable sheet feeding can be maintained over extended periods of time.

Also, a feeder of an image forming apparatus, to achieve the second object, includes separating pad displacing means for displacing a separating pad in a direction away from a feeding roller according to a thickness of a sheet passing through between the separating pad and the feeding roller, wherein, only when feeding sheets, said separating pad is pressed against said feeding roller, and the feeding roller is rotated, so as to separate stacked sheets into individual sheets between the feeding roller and the separating pad and carry the sheets individually to an image forming section.

According to the arrangement, since the separating pad displacing means displaces the separating pad in a direction away from the feeding roller according to a thickness of a sheet passing through between the separating pad and the feeding roller, an unnecessary increase of pressure brought about by differences in thickness of sheets can be avoided appropriately, in comparison with a conventional arrangement in which the separating pad was hardly displaced. Thus, the pressure of the separating pad can be made in accordance with a thickness of a sheet passing through between the separating pad and the feeding roller.

As a result, regardless of type, size, and surface smoothness of fed sheets, various sheets can be used to separate sheets into individual sheets without fail and without impairing sheet carrying performance, and transport of plural sheets can be prevented. The foregoing arrangement is particularly effective when applied to a feeder having a fixing type feeding cassette which cannot adjust separating pressure according to type or size of sheets and need to separate various sheets appropriately.

Further, a feeder of an image forming apparatus of the present invention, to achieve the first and the second objects includes, a rotatable pressing support base for pressing a separating pad against a feeding roller and for rotating the separating pad so that the separating pad is displaced in a direction away from the feeding roller in accordance with a thickness of a sheet passing through between the separating pad and the feeding roller; and support base moving means for moving the rotatable pressing support base between a standby position where the separating pad is separated from the feeding roller and a pressing position where the separating pad is pressed against the feeding roller, wherein, when feeding sheets, the separating pad is pressed against the feeding roller, and the feeding roller is rotated, so as to separate stacked sheets and carry the sheets individually to an image forming section.

According to the arrangement, since the rotatable pressing support base presses the separating pad against the feeding roller and rotates the separating pad in a direction away from the feeding roller according to a thickness of a sheet passing through between the separating pad and the feeding roller, an unnecessary increase of pressure brought about by differences in thickness of sheets can be avoided appropriately, in comparison with a conventional arrangement in which the separating pad was hardly displaced. Thus, the pressure of the separating pad can be made in accordance with a thickness of a sheet passing through between the separating pad and the feeding roller.

As a result, regardless of type, size, and surface smoothness of fed sheets, various sheets can be used to separate sheets into individual sheets without fail without impairing sheet carrying performance, and transport of plural sheets can be prevented. The foregoing arrangement is particularly effective when applied to a feeder having a fixing type feeding cassette which cannot adjust separating pressure according to type or size of sheets and need to separate various sheets appropriately.

Besides, since the holder moving means moves the rotatable pressing support base between a standby position where the separating pad is separated from the feeding roller and a pressing position where the separating pad is pressed against the feeding roller, the separating pad can be pressed against the feeding roller only when feeding sheets. Therefore, a pressed surface of the separating pad is hard to wear out, compared with a conventional arrangement in which the separating pad was pressed all the time. Thus, durability of the separating pad can be improved. As a result, stable feeding can be maintained over extended periods of time.

For a fuller understanding of the nature and advantages of the invention, reference should be made to the ensuing detailed description taken in conjunction with the accompanying drawings.

DESCRIPTION OF THE EMBODIMENT

The embodiment according to the present invention is described based on FIGS. 1(*a*) and 1(*b*) through FIG. 6 as follows.

Figure 2:
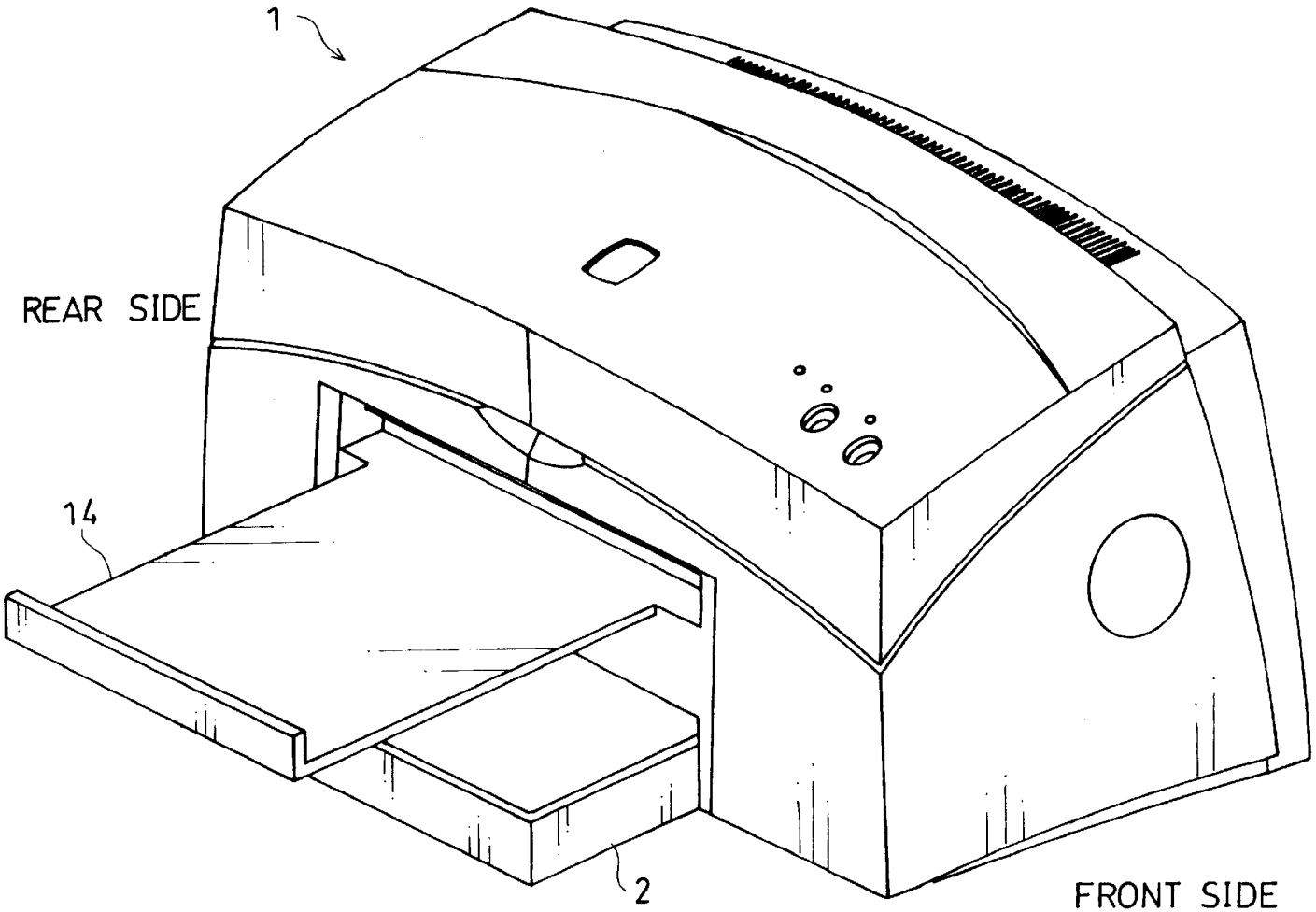
FIG. 2 is a perspective view showing an external appearance of the ink-jet printer.
Figure 3:
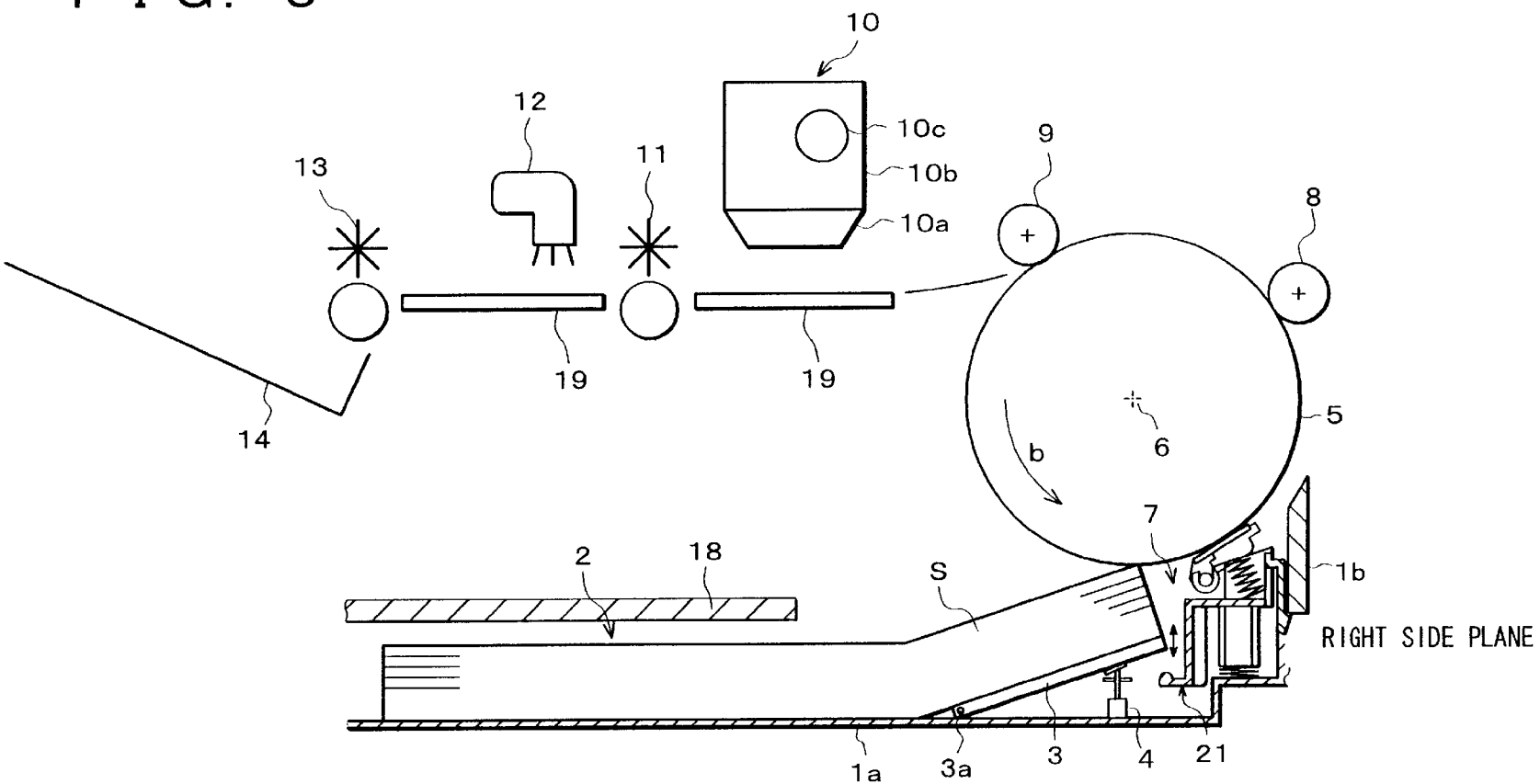
FIG. 3 is a cross sectional view showing an arrangement of the ink-jet printer.
Figure 4:
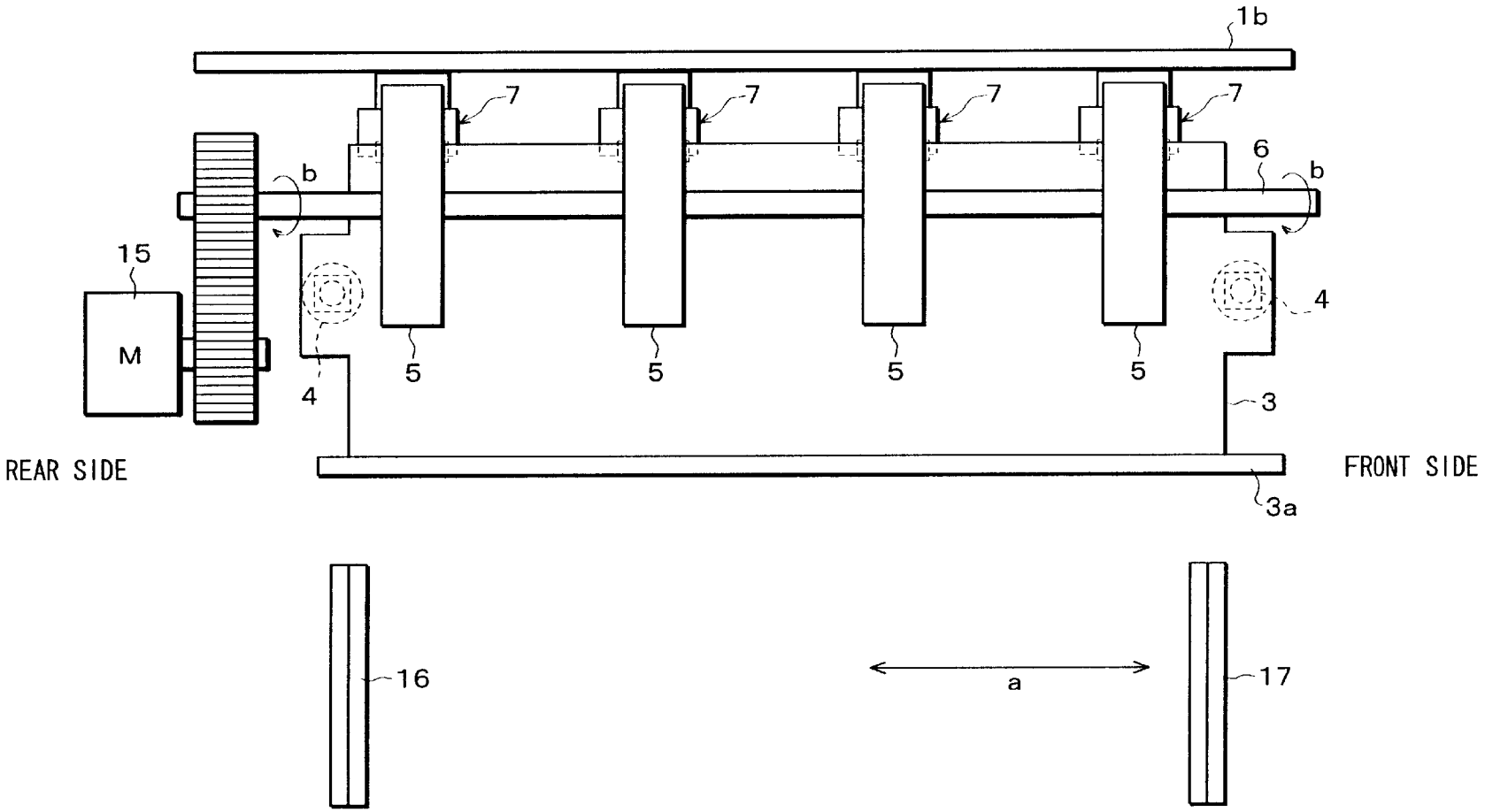
FIG. 4 is a plan view showing an arrangement in the vicinity of feeding rollers installed in a feeder of the ink-jet printer.

First, a schematic arrangement of an ink-jet printer 1 as an image forming apparatus provided with a feeder according to the present embodiment is described with reference to FIG. 2 to FIG. 4. FIG. 2 is an external view of the ink-jet printer as viewed from the front left side. FIG. 3 is a longitudinal cross sectional view showing a schematic arrangement of the ink-jet printer 1. FIG. 4 is a plan view showing an arrangement of a periphery of a feeding roller 5 which makes up a feeding device in the ink-jet printer 1.

The ink-jet printer 1 has a feeding cassette 2 which stores stacked sheets S on a bottom of the ink-jet printer 1. The feeding cassette is not detachable, but of a fixing type, and a bottom plate 1*a* of the ink-jet printer 1 makes up a bottom of the cassette. Thus, the bottom plate 1*a* of the ink-jet printer 1 has a sheet lifting plate (sheet lifting means) 3 for lifting the sheets S stored in the feeding cassette 2, and the sheets S stored in the feeding cassette 2 are stacked on the sheet lifting plate 3.

Further, the bottom plate 1*a* of the ink-jet printer making up the feeding cassette 2 has sheet inserting guides 16 and 17 (see FIG. 4) on the rear side and the front side, respectively, and a sheet inserting guide 18 (see FIG. 3) is provided at a predetermined distance from the bottom plate 1*a*. Guided by the sheet inserting guides 16 to 18, the sheets S are inserted from the left side plane of the ink-jet printer 1 into the feeding cassette 2. Of these sheets inserting guides, the sheet inserting guide 17 provided on the front side is movable back and forth in directions of an arrow a in FIG. 4, and aligns the sheets S stored in the feeding cassette 2 in a rear-front direction. Note that, though not shown particularly, the feeding cassette 2 is also provided with an aligning plate for aligning the stored sheets S in an insertion direction of the sheets S (same as feeding direction).

Below the sheet lifting plate 3, there is provided a solenoid 4 which is switched off to lift the sheet lifting plate 3 about a shaft 3a serving as a fulcrum when the ink-jet printer 1 is requested to print. The solenoid 4 is provided one each for the rear side and the front side of the sheet lifting plate 3. The sheet lifting plate 3 is lifted so that a leading end of the upper most sheet S of the stacked sheets S is pressed against the feeding roller 5 provided above the sheet lifting plate 3.

The feeding roller 5 against which the sheet S is pressed rotates in a direction shown by an arrow b in FIG. 3 and FIG. 4, and the force of rotation pulls the upper most sheet S of the stacked sheets S stored in the feeding cassette 2, and carries the pulled sheet S to a recording section (an image forming section) which is provided above the feeding cassette 2 and is described below. The feeding roller 5 has a roller part which is divided and provided on a shaft 6 which is provided along a body frame 1*b* which also makes up a right side wall of the ink-jet printer 1 and transmits the driving force of a motor 15. Here, the roller part is divided into four parts.

Below the feeding roller 5 and on the feeding side of the feeding cassette 2, there is provided a sheet separating section 7 for preventing transport of plural sheets S pulled out of the feeding cassette 2. The sheet separating section 7 is provided for each of the divided four rollers of the feeding roller 5 provided on the shaft 6. This is described more concretely later.

Further, around the feeding roller 5 and on the downstream in the sheet transport direction of the sheet separating section 7, there is provided a carrying roller 8 which helps the feeding roller 5 to carry the sheet S and a PS roller (a paper stop roller) 9 which adjusts a leading end of an image. The PS roller 9 matches a leading end of the sheet S with a leading end of the image in position. The PS roller 9 as well as the feeding roller 5 stops rotating temporarily, and rotates again at such a timing that the leading end of the sheet S and the leading end of the image are matched in position, so that the sheet S is carried to the recording section.

The recording section includes a recording device 10 and a drying device 12 in order. The recording device 10 is made up of an ink head 10*a* which sprays a needed ink corresponding to image data and prints an image on the sheet S, an ink carriage 10*b* for installing the ink head 10*a* therein, and an ink carriage holding shaft 10*c* which is provided to make the scanning smooth.

In recording, the sheet S is stopped temporarily, and at the time when the ink carriage 10*b* completes scanning of one line (one direction) in a main scanning direction, the sheet S is carried by a distance which corresponds to a length in a sub scanning direction of an area where plural ink nozzles of the ink head 10*a* are formed. Such processes corresponding to the image data are performed all the time, so that an image is formed on the sheet S with an ink. The printed sheet S is carried to the drying device 12 by a pair of carrying rollers 11.

The drying device 12 dries the ink on the sheet S by spraying air on the sheet S. After dried, the sheet S is discharged to a discharge tray 14 by a pair of discharging rollers 13. Note that, the members indicated by reference numeral 19 in FIG. 3, which were not described particular, are carrying guides for guiding the sheet S which is fed from the feeding cassette 2 and is discharged to the discharging tray 4.

Next, an arrangement of the sheet separating section 7 is concretely described with reference to FIG. 4 used in the foregoing description, and FIG. 1(*a*) and FIG. 1(*b*). FIG. 1(*a*) and FIG. 1(*b*) are longitudinal cross sections showing arrangements of the sheet separating section 7 making up the feeder and its periphery. FIG. 1(*a*) shows a state of the ink-jet printer 1 feeding sheets, and FIG. 1(*b*) shows a non-feeding state, that is, a standby state of the ink-jet printer 1.

The sheet separating section 7 is made up of a movable sheets separating unit (support base moving means) 21 with its upper surface provided with the separating pad 20 which is pressed against the feeding roller 5. The movable sheet separating unit 21 can move between a pressing position shown in FIG. 1(*a*) in which the separating pad 20 is pressed against the feeding roller 5, and a standby position shown in FIG. 1(*b*) in which the separating pad 20 is separated from the feeding roller 5, so that the movable sheet separating unit 21 is held in a pressing position only when feeding sheets to press the separating pad 20 against the feeding roller 5. Since the separating pad 20 is not pressed against the feeding roller 5 all the time but pressed only when feeding sheets, wear of the separating pad 20 is suppressed. Thus, durability of the separating pad 20 can be improved and stable sheet feeding can be realized over extended periods of time.

The movable sheet separating unit 21 chiefly includes a base 21*a* which also makes up a unit body, a rotatable support base 21*b* which is provided on the base 21*a* and rotatably supports the separating pad 20 on a fulcrum Z, a pressing spring (a first pushing member) 21*d* for pressing the separating pad 20 supported by the rotatable support base 21*b* against the feeding roller 5, and a stopper (position restricting means) 21*c* which is stopped on a body frame 1*b* so as to restrict height of the movable sheet separating unit 21 by a lifting spring (a second pushing member) 22.

Further, the base 21*a* is provided with an operation tongue 21*e* by which the height of the movable sheet separating unit 21 can be switched in an interlocking action with the up-down movement of the lifting plate 3 described above.

The base 21*a* is pushed by the lifting spring 22 whose end is fixed on the bottom plate la of the ink-jet printer 1, so that the movable sheet separating unit 21 is always pushed up toward the feeding roller 5. When the ink-jet printer 1 is in a non-feeding state, that is, a standby state, as shown in FIG. 1(*b*), the sheet lifting plate 3 is brought into contact with the operation tongue 21*e* provided on the base 21*a,* so that the operation tongue 21*e* is kept pushed downward and cannot move upward. Thus, the separating pad 20 can be maintained separated from the feeding roller 5.

Figure 1:
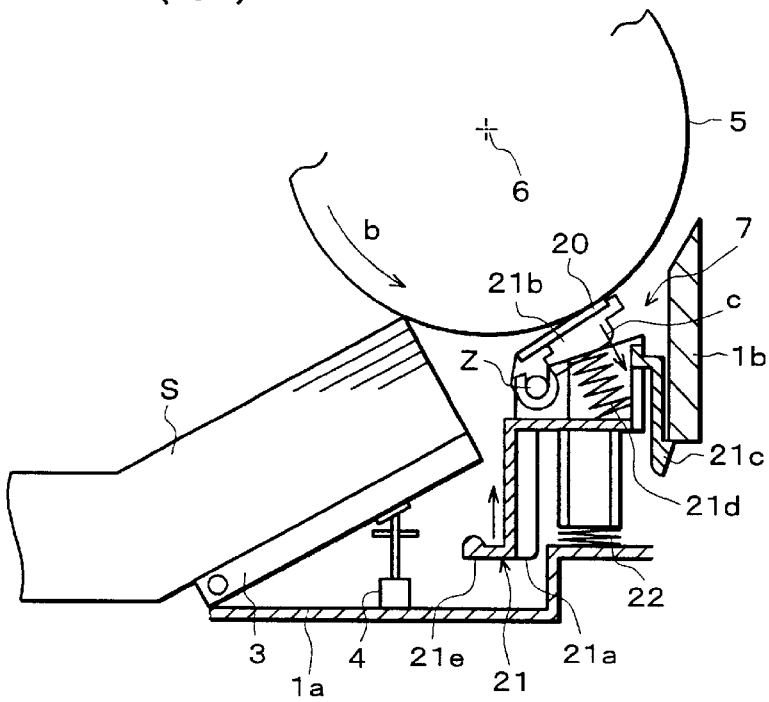
FIG. 1(*a*) is a cross sectional view showing a state of a feeder installed in an ink-jet printer as an image forming apparatus according to an embodiment of the present invention when feeding sheets, and FIG. 1(*b*) is a cross sectional view showing a state of the feeder in a non-feeding state.
Figure 1:
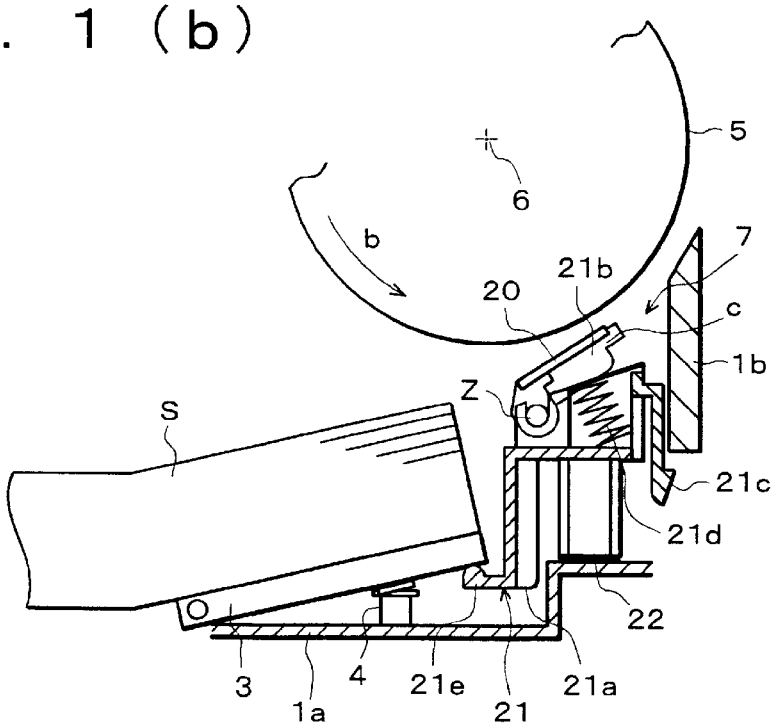

While, when the ink-jet printer 1 is in a feeding state, as shown FIG. 1(*a*), the solenoid 4 is switched off and the sheet lifting plate 3 moves upward, so that the operation tongue 21*e* which was maintained pressed downward is released in an interlocking action with this movement of the lifting plate 3. Thus, the movable sheet separating unit 21 moves upward by the pushing force of the lifting spring 22. Further, the stopper 21*c* provided on the base 21*a* is topped on the body frame 1*b,* so that the movable sheets separating unit 21 stops at a predetermined height regardless of the pushing force of the lifting spring 22. This stopping position is the pressing position where the separating pad 20 supported by the rotatable support base 21*b* is pressed against the feeding roller 5.

When the movable sheets separating unit 21 is in the pressing position, the separating pad 20 supported by the rotatable support base 21*b* is pressed against the feeding roller 5 by the pushing force of the pressing spring 21*d* which pushes the separating pad 20 via the rotatable support base 21*b* in a direction of the normal line. Here, the separating pad 20 is pressed against the feeding roller 5 in a direction in which the pushing force of the pressing spring 21*d* acts, and pressing is performed at a predetermined pressure needed to separate sheets. The stopper 21*c* is provided so that the pushing force of the lifting spring 22 does not directly influence the pressure of the separating pad 20 against the feeding roller 5. Thus, only the pushing force of the pressing spring 21*d* is needed to effect control, and it becomes easier to set the pressure.

When plural sheets S are inserted between the separating pad 20 and the feeding roller 5 in accordance with the rotation of the feeding roller 5 with the separating pad 20 being pressed against the feeding roller 5, a thickness of the plural sheets S generates force which acts on the separating pad 20 to spread a spacing between the separating pad 20 and the feeding roller 5.

In an arrangement of the conventional sheet separating section, the separating pad is not designed to displace its position away from the feeding roller even when a force acts on the separating pad to spread a spacing between the separating pad and the feeding roller. Thus, the plural sheets S are pressed against the feeding roller harder than needed. As a result, when the sheets S are thick papers such as post cards, there were cases where ends of the sheets S are rolled up or splinter.

On the other hand, in the sheet separating section 7 made up of the movable sheets separating unit 21, when a force acts on the separating pad 20 to spread a spacing between the separating pad 20 and the feeding roller 5, the separating pad 20 rotates in a direction shown by an arrow c in FIG. 1(*a*) and is displaced away from the feeding roller 5 so that the spacing between the separating pad 20 and the feeding roller 5 is spread. Thus, unlike the conventional arrangement, the plural sheets S are not pressed against the feeding roller 5 harder than needed. As a result, even when the sheets S are thick papers such as post cards, front ends of the sheets S are not rolled up or do not splinter at all. Needless to say, the more the separating pad 20 rotates and the pressing spring 21*d* is compressed, the stronger the pressure of the separating pad 20 against the feeding roller 5 will be, but increase of the pressure is within an appropriate range, and carrying performance of the sheets S is not impaired.

Further, particularly in the movable sheets separating unit 21, the pushing direction of the pressing spring 21*d* for pressing the separating pad 20 against the feeding roller 5 coincides with the direction of pressing down the separating pad 20. This is desirable to satisfy the condition required for the pressing spring 21*d,* that is to displace the separating pad 20 according to a thickness of the plural sheets S and exert a pressure required to separate the sheets.

Comparing the two springs used in the movable sheets separating unit 21, that is, the pressing spring 21*d* for pressing the separating pad 20 against the feeding roller 5 and the lifting spring 22 for lifting the movable sheets separating unit 21 from the standby position to the pressing position in terms of deformation brought about by loads, it is preferable that the pressing spring 21*d* is set to be more easily deformed than the lifting spring 22. In this way, the pressing spring 21*d* can absorb force which is brought about by a thickness of the sheets S inserted between the separating pad 20 and the feeding roller 5 and exerted on the separating pad 20 appropriately, while the movable sheets separating unit 21 is kept in the pressing position, thereby separating the sheets S efficiently.

Further, in the sheet separating section 7, the position of the movable sheets separating unit 21 is switched in an interlocking action with the movement of the sheet lifting plate 3 for lifting the sheets S when feeding sheets. Therefore, a switching operation by which the separating pad 20 is pressed against the feeding roller 5 only when feeding sheets can be realized easily without increasing the number of members.

Next, an arrangement of another movable sheet separating unit which is used instead of the movable sheets separating unit 21 to make up the sheet separating section 7 is described with reference to FIG. 5 and FIG. 6.

Figure 5:
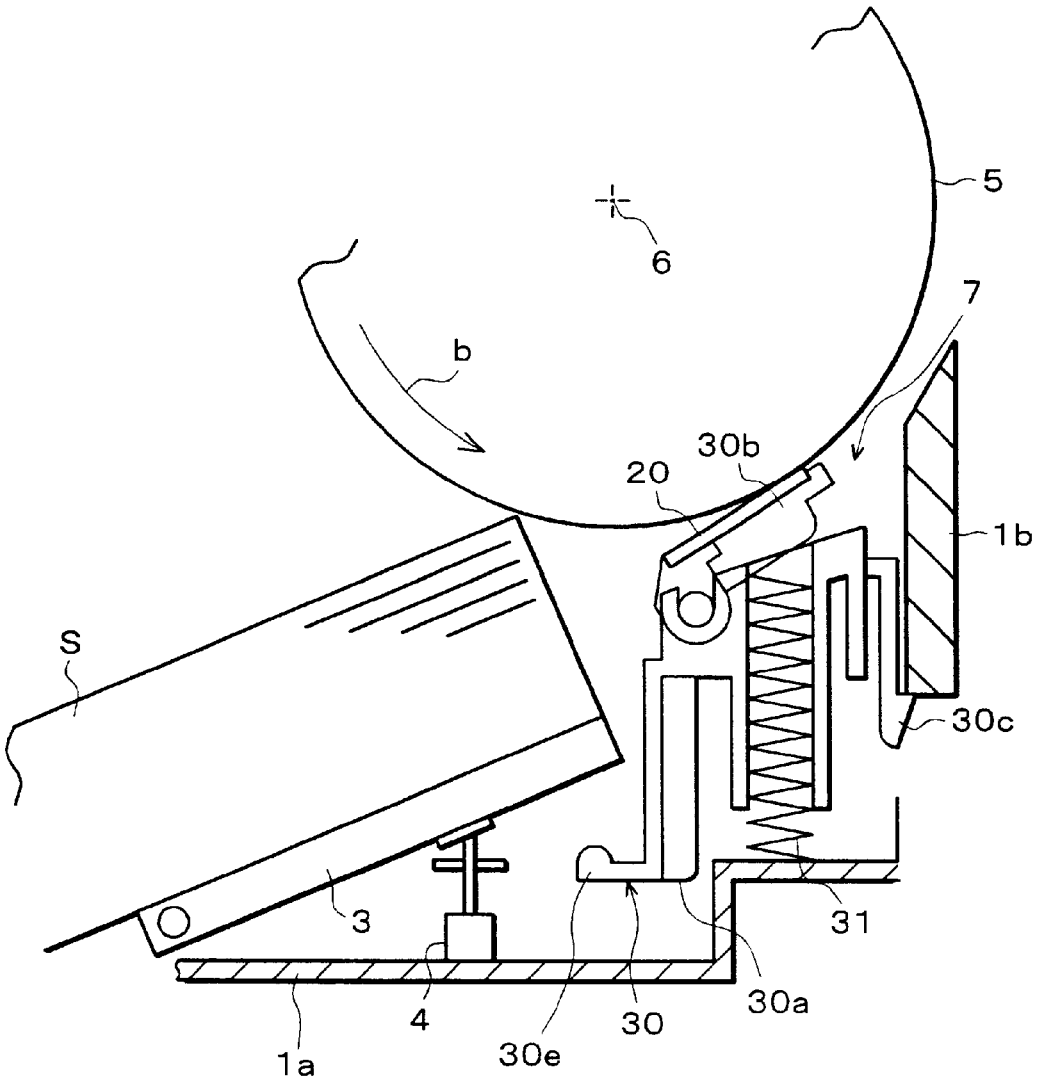
FIG. 5 is a cross sectional view showing an arrangement of another feeder installed in the ink-jet printer.

A single spring 31 is used instead of the two springs of the movable sheets separating unit 21 shown in FIG. 1(*a*) and FIG. 1(*b*), that is, the pressing spring 21*d* for pressing the separating pad 20 against the feeding roller 5 and the lifting spring 22 for lifting the movable sheets separating unit 21 from the standby position to the pressing position, so that a movable sheets separating unit 30 making up the sheet separating section 7 shown in FIG. 5 is made compact.

In the movable sheets separating unit 30, a rotatable support base 30b rotatably supporting the separating pad 20 is pushed, together with a unit body 30*a* on which the rotatable support base 30*b* is fastened, by a spring 31 whose end is fixed on the bottom plate 1*a* of the ink-jet printer 1, and the separating pad 20 is pressed against the feeding roller 5 with a predetermined pressure which acts on the separating pad 20 on an angle, as in the movable sheets separating unit 21 of FIG. 1(*a*).

In the movable sheets separating unit 30, a stopper 30*c* which restricts height of the movable sheet separating unit 30 at the pressing position against the pushing force and prevents the separating pad 20 from being pressed harder than needed against the feeding roller 5 functions as in the movable sheets separating unit 21. Further, switching between the pressing position and the standby position of the movable sheet separating unit 30 is made with an operation tongue 30*e* which is provided on the unit body 30*a,* in an interlocking action with up-down movement of the sheet lifting plate 3 as in the movable sheets separating unit 21.

Figure 6:
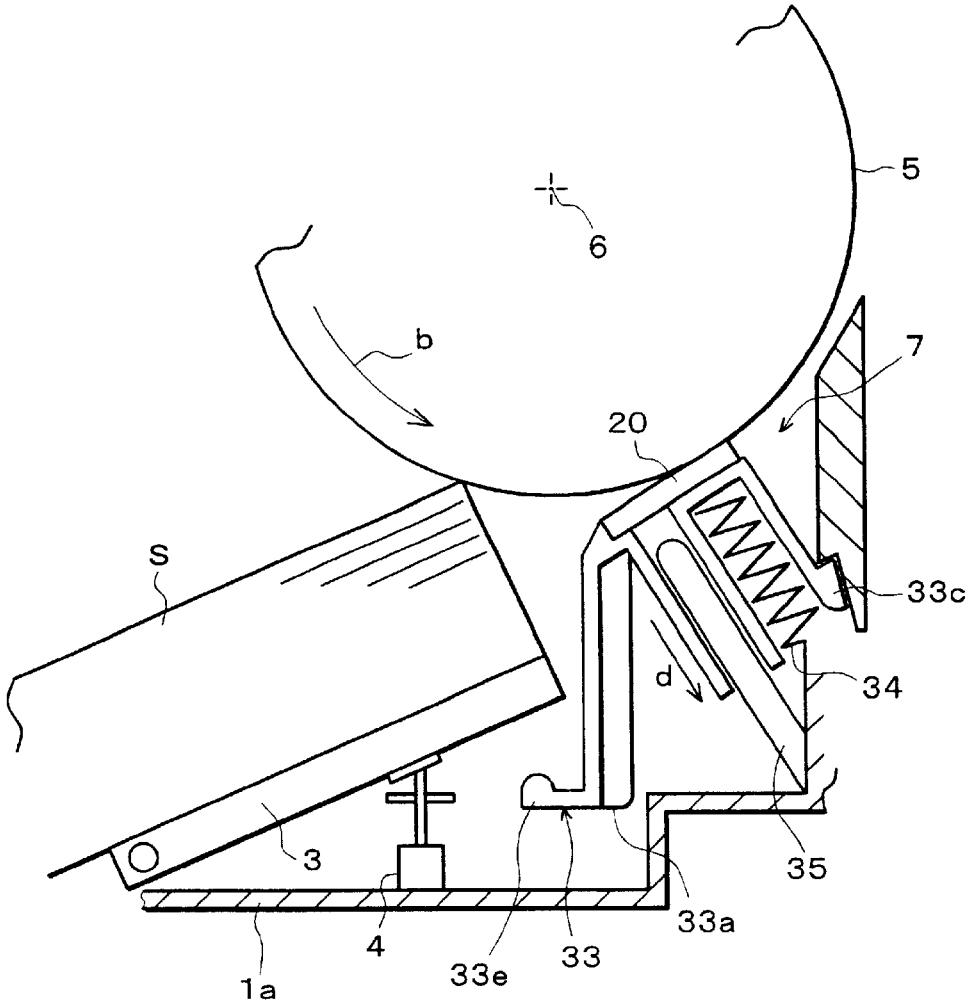
FIG. 6 is a cross sectional view showing an arrangement of still another feeder installed in the ink-jet printer.
Figure 7:
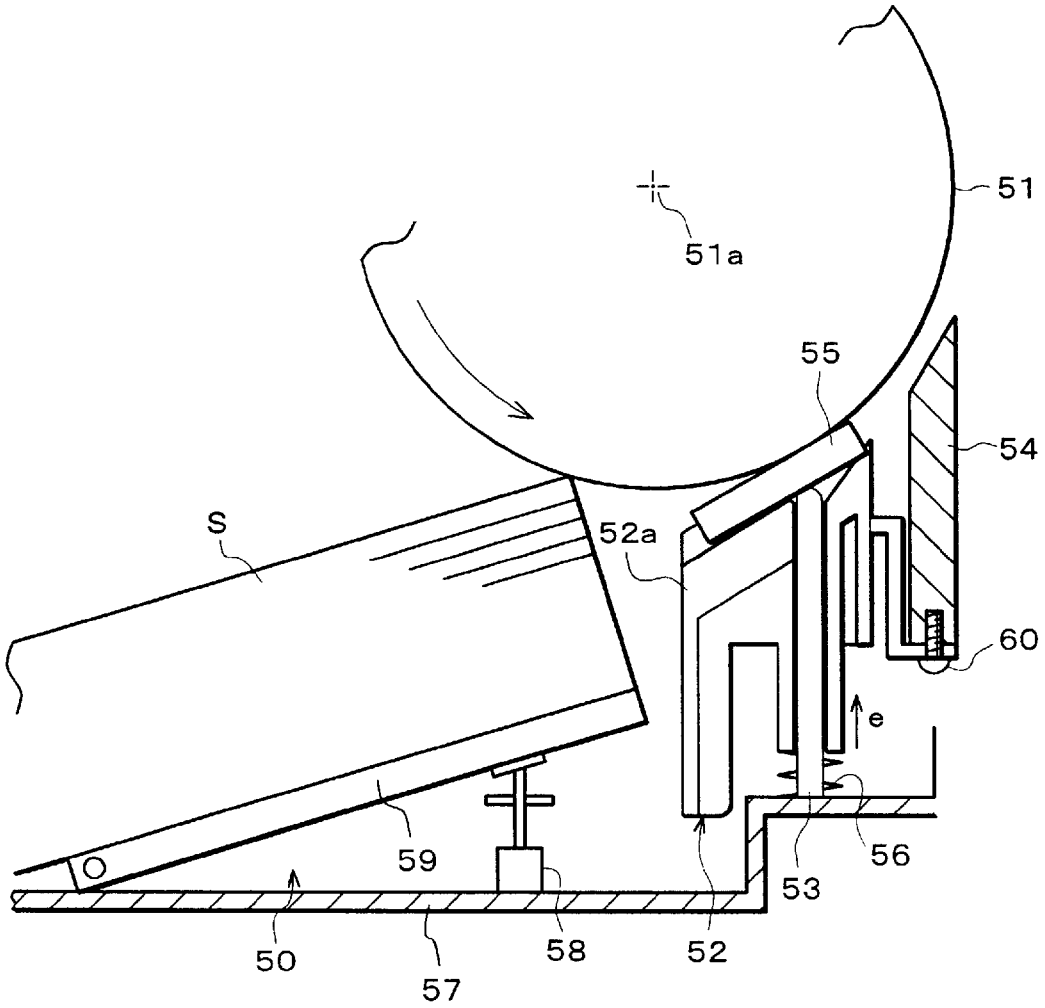
FIG. 7 is a cross sectional view showing an arrangement of a conventional feeder of an image forming apparatus.

While, the movable sheets separating unit 33 making up the sheet separating section 7 shown in FIG. 6 has an arrangement in which a single spring 34 is used instead of the two springs in the movable sheets separating unit 21 shown in FIG. 1(*a*) and FIG. 1(*b*), that is, the pressing spring 21*d* for pressing the separating pad 20 against the feeding roller 5 and the lifting spring 22 for lifting the movable sheets separating unit 21 itself from the standby position to the pressing position, and the separating pad 20 is separated from the feeding roller 5 according to a thickness of the sheets S inserted between the separating pad 20 and the feeding roller 5 not by rotating the separating pad 20, but by entirely moving a unit body 33*a* making up the movable sheets separating unit 33 in a direction of a normal line of the separating pad 20 shown by an arrow d in FIG. 6.

Thus, a guide rib 35, which is provided on the side wall of the body of the ink-jet printer 1 for restricting a moving direction of the movable sheets separating unit 33, is tilted along a direction of a normal line of the separating pad 20. The spring 34 whose end is fixed on the side wall is pushed in a direction of a normal line of the separating pad 20 so that the separating pad 20 is more easily displaced according to a thickness of the sheets S.

In the movable sheets separating unit 33, a stopper 33*c* which restricts height of the movable sheets separating unit 33 at the pressing position against the pushing force of the spring 34 and prevents the separating pad 20 from being pressed harder than needed against the feeding roller 5 functions as in the movable sheets separating unit 21. Further, with an operation tongue 33*e* which is provided on the unit body 33*a,* switching between the pressing position and the standby position is made in an interlocking action with the up-down movement of the sheet lifting plate 3 as in the movable sheets separating unit 21.

Note that, although not shown in particular, the guide rib for restricting the direction of movement is also provided for the two movable sheets separating units 21 and 30.

As described above, a feeder of an image forming apparatus of the present invention in which a separating pad is pressed against a feeding roller, and the feeding roller rotates is rotated, so as to separate stacked sheets into individual sheets between the feeding roller and the separating pad and carry the sheets individually to an image forming section, includes pressure switching means for pressing the separating pad against the feeding roller only when feeding sheets.

According to this arrangement, since the separating pad is pressed against the feeding roller only when feeding sheets by the pressure switching means, the surface of the separating pad pressed against the feeding roller is hard to wear and durability of the separating pad can be improved compared with a conventional arrangement in which the separating pad is pressed against the feeding roller all the time. As a result, stable feeding can be maintained over extended periods of time.

Further, the feeder of the image forming apparatus may also have an arrangement including sheet lifting means for lifting a front end of the stacked sheets to bring it into contact with the feeding roller when feeding sheets, wherein said pressure switching means presses the separating pad against the feeding roller in an interlocking action with the lifting operation of the sheet lifting means.

According to this arrangement, since ON/OFF of the pressure on the separating pad is switched by the pressure switching means in an interlocking action with the lifting operation of the sheet lifting means which lifts a front end of the stacked sheets when feeding sheets, the switching operation, by which the separating pad is pressed against the feeding roller only when feeding sheets, can easily be realized without additionally providing the pressure switching means with a member for pressing the separating pad against the feeding roller only when feeding sheets.

Another feeder of the image forming apparatus in which, the separating pad is pressed against said feeding roller, and the feeding roller is rotated, so as to separate stacked sheets into individual sheets between the feeding roller and the separating pad and carry the sheets individually to an image forming section, includes separating pad displacing means for displacing a separating pad in a direction away from a feeding roller according to a thickness of a sheet passing through between the separating pad and the feeding roller.

According to this arrangement, pad displacing means displaces the separating pad in a direction away from the feeding roller according to a thickness of a sheet passing through between the separating pad and the feeding roller. Thus, compared with a conventional arrangement in which the separating pad was hardly displaced, unnecessary pressure brought about by differences in thickness of sheets can be avoided appropriately, and the pressure exerted by the separating pad can be changed according to a thickness of a sheet passing through between the separating pad and the feeding roller.

As a result, regardless of type, size, and surface smoothness of fed sheets, various sheets can be separated into individual sheets without impairing sheet carrying performance and transport of two or more sheets can be prevented. Particularly, this can provide a feeder suitable for a fixing type feeding cassette which cannot adjust separating pressure according to type and size of sheets and needs to separate various sheets properly.

Further, in the feeder of the image forming apparatus, said separating pad displacing means includes a first pushing member for pressing the separating pad against the feeding roller, and a pushing force of the first pushing member is set so that the separating pad is displaceable in a direction away from the feeding roller according to a thickness of the sheet passing between the separating pad and the feeding roller. Thus, the feeder achieving the effects described above can be realized easily.

Further, in the case where the separating pad displacing means is made up of the first pushing member for pressing the separating pad against the feeding roller, said separating pad has a rotating fulcrum so that the separating pad is displaced by rotation in a direction away from the feeding roller against the pushing force of the first pushing member according to a thickness of the sheet passing between the separating pad and the feeding roller.

According to this, since the separating pad is separated from the feeding roller in accordance with the rotation movement using an end of the separating pad as a fulcrum, the separating pad rotates according to changes of thickness of the sheets without the pushing force of the first pushing member as in the arrangement in which the separating pad is displaced in parallel with respect to the feeding roller, so that sheet carrying performance can be improved and transport of plural sheets can be prevented, in addition to improving, durability of the separating pad.

Still another feeder of the image forming apparatus of the present invention in which the separating pad is pressed against the feeding roller, and the feeding roller is rotated, so as to separate stacked sheets and carry the sheets individually to an image forming section, includes a rotatable pressing support base for pressing a separating pad against a feeding roller and for rotating the separating pad so that the separating pad is displaced in a direction away from the feeding roller in accordance with a thickness of a sheet passing through between the separating pad and the feeding roller; and support base moving means for moving the rotatable pressing support base between a standby position where the separating pad is separated from the feeding roller and a pressing position where the separating pad is pressed against the feeding roller.

According to this, since the rotatable pressing support base presses the separating pad against the feeding roller and rotates the separating pad in a direction away from the feeding roller according to a thickness of a sheet passing through between the separating pad and the feeding roller, an unnecessary increase of pressure brought about by differences in thickness of sheets can be avoided appropriately, compared with a conventional arrangement in which the separating pad was hardly displaced. Thus, the pressure of the separating pad can be made in accordance with a thickness of a sheet passing through between the separating pad and the feeding roller.

As a result, regardless of type, size, and surface smoothness of fed sheets, various sheets can be used to separate sheets into individual sheets without fail and without impairing sheet carrying performance, and transport of plural sheets can be prevented. Particularly, it is possible to provide the feeder suitable for a fixing type feeding cassette which cannot adjust separating pressure according to type and size of sheets and needs to separate various sheets properly.

Besides, since the support base moving means moves the rotatable pressing support base between the standby position where the separating pad is separated from the feeding roller and the pressing position where the separating pad is pressed against the feeding roller, the separating pad can be pressed against the feeding roller only when feeding sheets. Thus, the pressed surface of the separating pad is hard to wear, compared with a conventional arrangement in which the separating pad was pressed all the time. Therefore, durability of the separating pad can be improved. As a result, stable feeding can be maintained over extended periods of time.

Further, the feeder of the image forming apparatus may have an arrangement in which said support base moving means includes a second pushing member for lifting the rotatable pressing support base toward the feeding roller so as to press the separating pad against the feeding roller, and a position restricting member which is stopped on a frame of an image forming apparatus body so as to restrict a position of the rotatable pressing support base lifted by the second pushing member to the pressing position.

According to this, the rotatable pressing support base is lifted by the second pushing member which is provided on the support base moving means so that the separating pad supported by pressure on the rotatable pressing support base is pressed against the feeding roller. Here, the position restricting member is stopped on the frame of the image forming apparatus body to restrict a position of the rotatable pressing support base lifted by the second pushing member to the pressing position. Thus, the separating pad is pressed against the feeding roller by the pressure force of the rotatable pressing support base, and unnecessary pushing force of the second pushing member which lifts the rotatable pressing holder is not applied to the separating pad so as not to impede the displacement of the separating pad. As a result, the feeder of the image forming apparatus can function appropriately based on the foregoing arrangement.

Further, the feeder of the image forming apparatus may have an arrangement including sheet lifting means for lifting a front end of the stacked sheets to bring it into contact with the feeding roller when feeding sheets, wherein said support base moving means moves the rotatable pressing support base to the pressing position in an interlocking action with the lifting operation of the sheet lifting means.

According to this, since the switching operation for displacing the rotatable pressing support base (standby position/pressing position) is performed in an interlocking action with the lifting movement of the sheet lifting means for lifting a front end of the stacked sheets, it is not required to provide an additional member for moving the rotatable pressing support base to the pressing position and pressing the separating pad against the feeding roller only when feeding sheets. Thus, it is easy to perform the switching operation for pressing the separating pad against the feeding roller only when feeding sheets.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A feeder of an image forming apparatus in which only when feeding sheets, a separating pad is pressed against a feeding roller, and the feeding roller is rotated, so as to separate stacked sheets into individual sheets between the feeding roller and the separating pad and carry the sheets individually to an image forming section, said feeder comprising:

separating pad displacing means including a first pushing member for pressing the separating pad against the feeding roller, a pushing force of said first pushing member being set so that the separating pad is displaceable in a direction away from the feeding roller according to a thickness of the sheet passing between the separating pad and the feeding roller;

support base moving means, supporting the separating pad and the separating pad displacing means, that moves the separating pad between a standby position where the separating pad is separated from the feeding roller and a pressing position where the separating pad is pressed against the feeding roller; and a second pushing member for lifting the support base moving means toward the feeding roller so as to press the separating pad against the feeding roller.

2. The feeder of the image forming apparatus set forth in claim 1, wherein the separating pad is separated from the feeding roller in a direction of a normal line of the feeding roller.

3. The feeder of the image forming apparatus set in forth in claim 1, wherein said separating pad has a rotating fulcrum so that the separating pad is displaced by rotation in a direction away from the feeding roller against the pushing force of the first pushing member according to a thickness of the sheet passing between the separating pad and the feeding roller.

4. The feeder of the image forming apparatus set forth in claim 1, wherein the first pushing member is set so that it is deformed more easily than the second pushing member.

5. A feeder of an image forming apparatus, in which only when feeding sheets, a separating pad is pressed against a feeding roller, and the feeding roller is rotated, so as to separate stacked sheets into individual sheets between the feeding roller and the separating pad and carry the sheets individually to an image forming section, said feeder comprising:

a rotatable pressing support base for pressing a separating pad against a feeding roller and for rotating the separating pad so that the separating pad is displaced in a direction away from the feeding roller in accordance with a thickness of a sheet passing through between the separating pad and the feeding roller;

separating pad displacing means including a first pushing member for pressing the separating pad against the feeding roller via the rotatable pressing support base, a pushing force of said first pushing member being set so that the separating pad is displaceable in a direction away from the feeding roller according to a thickness of the sheet passing between the separating pad and the feeding roller;

support base moving means, supporting the separating pad, the rotatable pressing support base, and the separating pad displacing means, that moves the separating pad between a standby position where the separating pad is separated from the feeding roller and a pressing position where the separating pad is pressed against the feeding roller; and a second pushing member for lifting the support base moving means toward the feeding roller so as to press the separating pad against the feeding roller.

6. The feeder of the image forming apparatus set forth in claim 5 wherein said support base moving means includes a position restricting member which is stopped on a frame of an image forming apparatus body so as to restrict a position of the rotatable pressing support base lifted by the second pushing member to the pressing position.

7. The feeder of the image forming apparatus set in forth in claim 5, comprising:

sheet lifting means for lifting a front end of the stacked sheets to bring it into contact with the feeding roller, wherein said support base moving means moves the rotatable pressing support base to the pressing position in an interlocking action with the lifting operation of the sheet lifting means.

8. The feeder of the image forming apparatus set forth in claim 7, wherein said first pushing member is set so that it is deformed more easily than the second pushing member.

* * * * *